US006997758B2

(12) United States Patent
De Buyst et al.

(10) Patent No.: US 6,997,758 B2
(45) Date of Patent: Feb. 14, 2006

(54) CONNECTOR FOR CONNECTING TWO ELECTRICAL POWER CABLES AND A CONNECTION INCLUDING THE CONNECTOR

(75) Inventors: Jo De Buyst, Lede (BE); Josef Cardinaels, Wetteren (BE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/650,483

(22) Filed: Aug. 27, 2003

(65) Prior Publication Data

US 2004/0102081 A1 May 27, 2004

(30) Foreign Application Priority Data

Aug. 30, 2002 (FR) ..... 02 11207

(51) Int. Cl.
*H01R 11/09* (2006.01)

(52) U.S. Cl. ..... 439/797; 439/447; 174/88 R

(58) Field of Classification Search ..... 439/796, 439/797, 798, 810, 813, 814, 447; 174/DIG. 8, 174/84 R, 88 R
See application file for complete search history.

(56) References Cited

U.S. PATENT DOCUMENTS

| | | | | |
|---|---|---|---|---|
| 2,901,725 | A * | 8/1959 | Schuyler | 439/797 |
| 5,630,735 | A * | 5/1997 | Eckert | 439/721 |
| 6,325,678 | B1 * | 12/2001 | Auclair | 439/803 |

FOREIGN PATENT DOCUMENTS

| | | | |
|---|---|---|---|
| DE | 2730232 | 3/1979 | 15/18 |
| EP | 0698942 | 2/1996 | 15/10 |
| EP | 1206024 | 11/2000 | 15/184 |
| FR | 001206024 A1 * | 5/2002 | |

* cited by examiner

*Primary Examiner*—Ross Gushi
(74) *Attorney, Agent, or Firm*—Sofer & Haroun, LLP

(57) ABSTRACT

A connector for connecting two medium-voltage electrical power cables each including at least one conductor surrounded by an insulative jacket includes tubular screw contacts which connect together stripped ends of the conductors inserted into the contacts and retained by screws. An extension attached to at least one end of the connector covers a portion of the insulative jacket of the cable over a length greater than 10 mm.

10 Claims, 2 Drawing Sheets

CONNECTOR FOR CONNECTING TWO ELECTRICAL POWER CABLES AND A CONNECTION INCLUDING THE CONNECTOR

RELATED APPLICATIONS

This application is related to and claims the benefit of priority from French Patent Application No. 02 11207 filed Aug. 30, 2002.

BACKGROUND OF THE INVENTION

1. Field of the Invention

The present invention relates to a connector for connecting two electrical power cables and to a connection including the connector.

It relates more specifically to a connector for connecting two medium-voltage electrical power cables each comprising a conductor surrounded by an insulative jacket, and possibly a semiconductor layer, the connector including tubular screw contacts and being adapted to connect together the stripped ends of said conductors inserted into said contacts and retained by means of screws.

2. Description of the Prior Art

A cable connection including the above kind of connector is disclosed in the patent document GB 2 254 739. The connector used in the above prior art cable connection is covered with a heat-shrink insulative sheath. The sheath is positioned over the connector and heated to shrink it, remaining in the shrunk configuration after the heating operation. The sheath therefore tends to assume the shape of the underlying connector and the insulative jacket of each of the cables. However, there always remain gaps at the places where the diameter changes, i.e. between the insulative jacket and the connector, as well as gaps caused by the irregular shape of the connector, in particular the heads of the screws. In the above prior art solution, to fill in the gaps, a film of insulative mastic is wrapped around the connector before shrinking the sheath.

The difference in diameter between the insulative jacket and the connector is essentially caused by the fact that the screw contact assembly generally has a wide range of cross sections, for example from 50 $mm^2$ to 300 $mm^2$, and is therefore larger than the insulative jacket of each cable. A screw connector of the above kind is disclosed in the patent document GB 2 262 396, for example. Moreover, the connector is eccentrically disposed with respect to the conductor. This is caused by the presence of the screws, which further increase the difference in dimensions between the insulative jacket and the connector. The heads of the screws and the screwthreads cause sharp edges on the surface of the connector. As a result, the insulative sheath cannot faithfully follow the contours of the insulative jacket of each cable and of the surfaces of the connector and the insulative mastic is exposed to an electric field that is too high precisely at the places that are the most critical from the electrical point of view. This is a problem that can lead to breakdown of the connection, especially for applications at voltages of 10 kV and above.

One proposed solution is described in the patent document EP 1 206 024.

According to this prior art solution, the connection is provided with two molded semiconductor rubber caps covering a portion of the insulative jacket of the corresponding cable and joined together above the connector, each of said caps having an internal shape adapted to be engaged over the connector and to fill in the gap formed by the difference in dimension between the connector and the insulative jacket of the corresponding cable.

This kind of arrangement provides a result that is satisfactory from the electrical point of view but is difficult to fit. The two separate caps separate from the connector must be threaded over the ends of the cable before connecting the cables by means of the connector and then pushed over the connector before fitting the insulative sheath.

The patent document DE 27 40 232 proposes a connector for connecting two electrical power cables each comprising a conductor surrounded by an insulative jacket, the connector comprising tubular screw contacts and being adapted to connect together the stripped ends of conductors inserted into the contacts and retained by means of screws. The above connector has at its end an extension forming part of the connector and adapted to cover a portion of the insulative jacket of the cable. The length covered is of the order of a few millimeters.

On medium-voltage cables, the insulative jacket can shrink by several millimeters, up to 10 mm. The above kind of connector is therefore not suitable for providing a permanent covering, and in the event of shrinkage of the insulative jacket, which is not uncommon with this type of cable, a gap is created that encourages breakdown, as explained above.

SUMMARY OF THE INVENTION

The invention proposes to solve the above technical problem and to this end provides a connector for connecting two medium-voltage electrical power cables each including at least one conductor surrounded by an insulative jacket, which connector includes tubular screw contacts adapted to connect together stripped ends of the conductors inserted into the contacts and retained by means of screws and, at one end at least, extension means attached to the connector and adapted to cover a portion of the insulative jacket of the cable over a length greater than 10 mm.

Fastened to the connector, the extension means are disposed when fitting the connector, without additional manipulation.

The covering means preferably cover the insulative jacket over a length from 10 mm to 20 mm.

In a preferred embodiment the extension means have a rounded free end.

The extension means project above the insulative jacket of the cable or onto the jacket and form a screen in this transition area at the end of the connector, where high electrical fields exist, the local electrical stresses being liable to cause partial discharges and connection defects. Thanks to its rounded free end, the conformed sheath ensures a good distribution of the electric field.

In a first embodiment, the extension means comprise a rigid annular flange at the periphery of the connector.

The flange is preferably an integral part of the connector.

In a second embodiment, the extension means comprise a flexible semiconductor rubber skirt fixed to the periphery of the connector.

The invention also provides a connection between two medium-voltage electrical power cables each including at least one conductor surrounded by an insulative jacket, the connection including a connector as described above and an insulative sheath adapted to cover intimately at least the connector.

The space between the connector and the insulative jacket of the corresponding cable is advantageously filled with a layer of insulative mastic.

The above layer of insulative mastic is applied by the insulative jacket as it shrinks and fills all remaining air pockets.

The space between the layer of insulative mastic and each screw is preferably filled with conductive mastic.

The invention is described in more detail hereinafter with the aid of figures showing preferred embodiments of the invention.

DETAILED DESCRIPTION OF THE PREFERRED EMBODIMENTS

The following description relates to the connection of two medium-voltage (more than 10 kV) cables. Although single-conductor cables are described, the invention applies equally to multiconductor cables.

Figure 1:
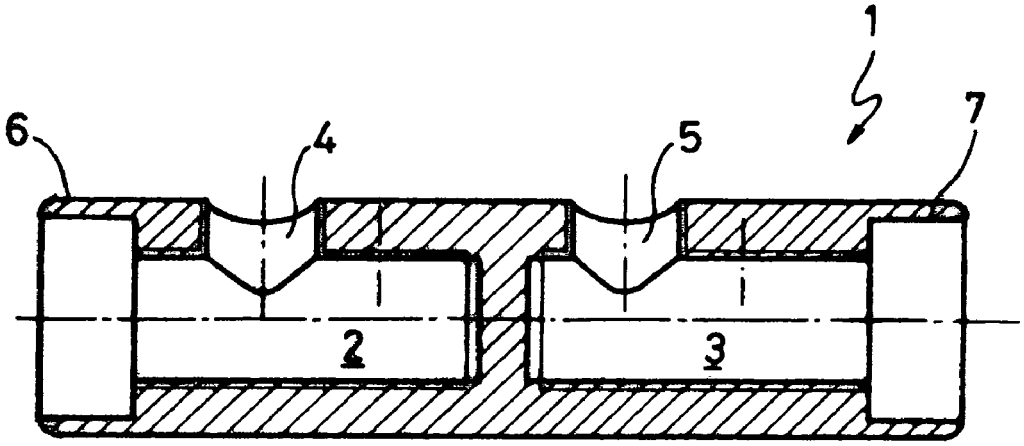
FIG. 1 is a view in longitudinal section of a first embodiment of a connector according to the invention.

Thus FIG. 1 shows a connector conforming to a first embodiment of the invention.

The conductor connector 1 comprises, as known in the art, a cylindrical body with two longitudinal cylindrical orifices 2, 3 known as contacts, each adapted to receive the end of a conductor when the ends of the cable have been stripped. Into the longitudinal orifices 2, 3 open respective tapped bores 4, 5 each adapted to receive a locking screw making electrical contact with the conductor. The connector 1 has at each end extension means attached to the connector 1 and consisting of a rigid annular flange 6, 7 disposed at the periphery of the connector, and to be more specific having an outside diameter equal to that of the connector and an inside diameter greater than that of the insulative jacket of the largest cable in the range covered. The covering means cover a length of the insulative jacket 11 greater than 10 mm and preferably from 10 mm to 20 mm.

In the preferred embodiment described here, the flange 6, 7 is approximately 15 mm long.

The flange 6 is preferably an integral part of the connector 1 and its free end is rounded.

Figure 2:
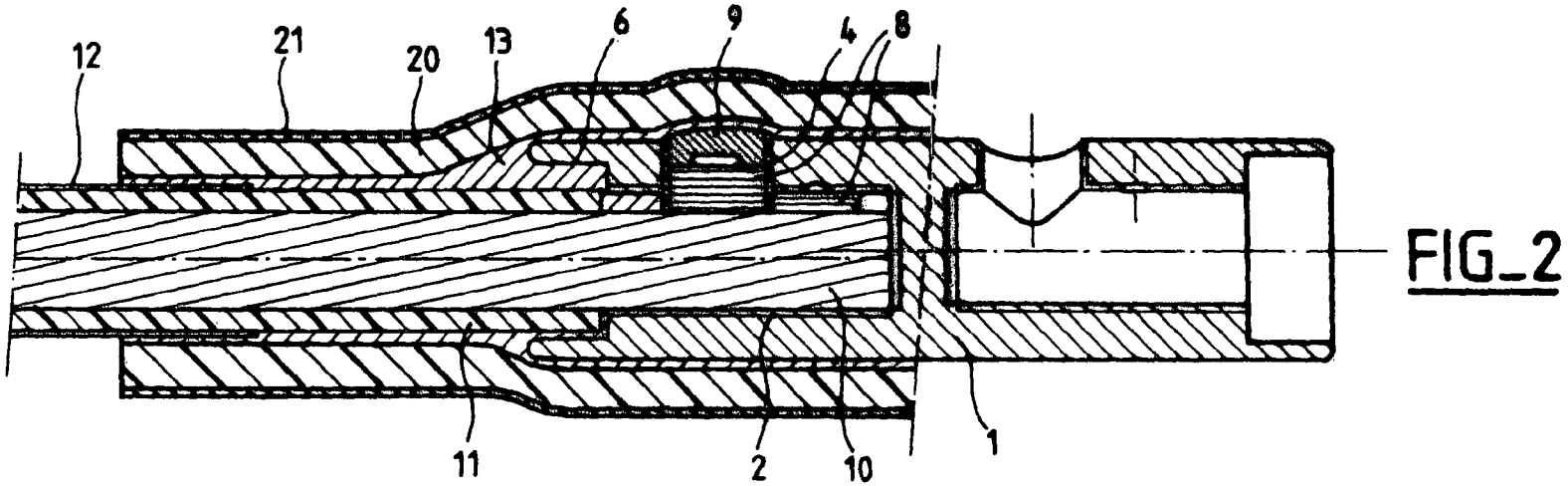
FIG. 2 is a partial view in longitudinal section of a first embodiment of a connection conforming to the invention between two cables.

FIG. 2 shows part of a connection between two cables using the connector shown in FIG. 1. This connection being symmetrical with respect to a vertical axis as seen in the figure, only one of the connected cables is shown.

The end of the cable is stripped and the conductor 10 is nested in the contact 2 with the end of the insulative jacket 11 of the cable near the end of the contact 2. The semiconductor covering 12 of the jacket 11 is removed over a greater length in order to be covered by the insulative sheath 20, which can be shrunk hot or cold and is itself covered with a semiconductor layer 21. The screws 8 of the connector are screwed down to clamp the conductor 10 against the wall of the connector and the space above each screw 8 is filled with conductive mastic or a semiconductor material cap 9. The shrinkable sheath 20 is fitted and espouses the external contour of the connector 1 and the cable.

The flange 6 therefore projects above the insulative jacket 11 of the cable and forms a screen in this transition area.

Because of the annular flange 6, when the sheath 20 is pressed against the flange, a relatively large gap remains between the flange 6 and the insulative jacket 11 of the cable, on the one hand, and between the sheath 20 and the jacket 11, on the other hand. This gap is easily filled with insulative mastic 13, which also fills the interfaces between the sheath 20 and the connector 1 and the insulative jacket 20 of the cable, the mastic expelling the air and providing a connection of high dielectric strength. This layer of insulative mastic is applied by the insulative sheath as it shrinks.

Figure 3:
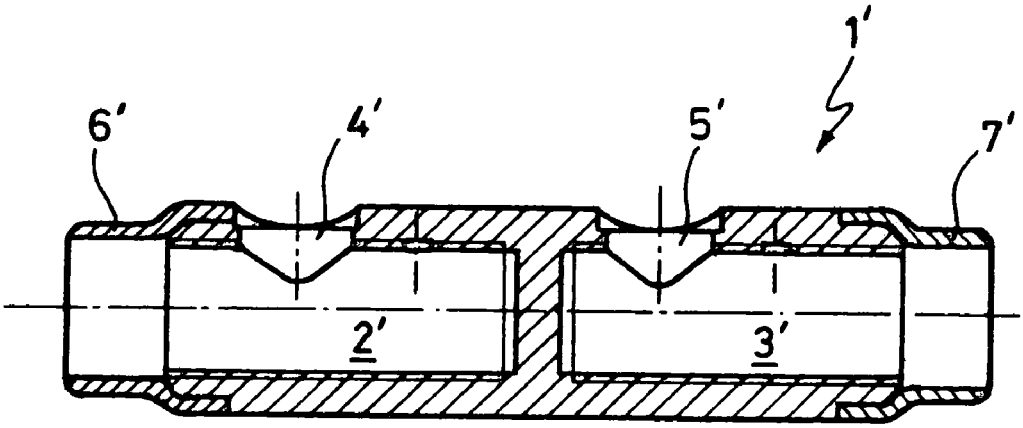
FIG. 3 is a view in longitudinal section of a second embodiment of a connector according to the invention.

FIG. 3 shows a second embodiment of a connector according to the invention.

The conductor connector 1' comprises, as known in the art, a cylindrical body with two longitudinal cylindrical orifices 2', 3' known as contacts each adapted to receive the end of a conductor when the ends of the cable have been stripped. Into these longitudinal orifices 2', 3' open respective tapped bores 4', 5' each adapted to receive a locking screw making the electrical contact to each conductor.

The connector 1' has at each end extension means attached to the connector 1' and consisting of a flexible semiconductor rubber skirt 6', 7' fixed to the periphery of the connector, and to be more specific having an external diameter less than that of the connector and an internal diameter matching the diameter of the insulative jacket of the smallest cable in the range covered, the end of this skirt being rounded.

In the preferred embodiment described here, the skirt 6', 7' forms an extension approximately 15 mm long.

Figure 4:
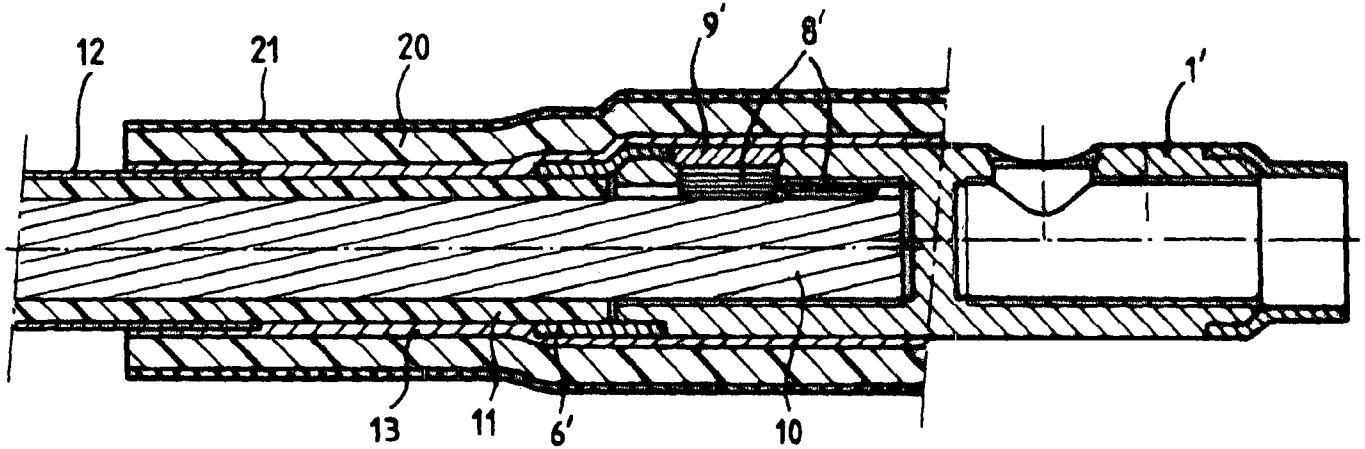
FIG. 4 is a partial view in longitudinal section of a second embodiment of a connection conforming to the invention between two cables.

FIG. 4 shows part of a connection between two cables using the connector shown in FIG. 3. This connection being symmetrical with respect to a vertical axis as seen in the figure, only one of the connected cables is shown.

The end of the cable is stripped and the conductor 10 is nested in the contact 2' with the end of the insulative jacket 11 of the cable near the end of the connector 1'. The semiconductor coating 12 of the sheaths 11 is removed over a greater length in order to be covered by the insulative sheath 20, which can be shrunk hot or cold, and is itself coated with a semiconductor layer 21. The screws 8' of the connector are screwed in to clamp the conductor 10 against the wall of the connector and the space above each screw 8' is filled with conductive mastic or a semiconductor material cap 9'. The shrinkable sheath 20 is fitted and espouses the external contour of the connector 1' and the cable, applying a layer of insulative mastic 13 which fills in the remaining surface irregularities.

The skirt 6' therefore projects onto the insulative jacket 11 of the cable, intimately covers the jacket 11, thanks to its flexibility, and forms a screen in this transition area. The internal diameter of the skirt 6' is chosen to suit the smallest diameter insulative jacket of the cables to be connected by the connector 1'. For larger insulative jacket diameters, the skirt 6' expands elastically to surround the insulative jacket.

The interfaces between the sheath 20 and the connector 1 and the insulative jacket 20 of the cable are filled in with insulative mastic 13.

What is claimed is:

1. A connection assembly for connecting two medium-voltage electrical power cables, each power cable including at least one conductor surrounded by an insulative jacket, each said connection assembly having a connector comprising:

tubular contacts adapted to connect together stripped ends of said conductors inserted into said tubular contacts and retained in said tubular contacts by means of screws, said screws directly contacting said stripped ends of said conductors; and at one end at least, extension means extending from the periphery of said connector adapted to cover a portion of said insulative jacket of said cable over a length greater than 10 mm, wherein said extension means is a flexible semiconductor rubber skirt, such that when said power cables are placed in said connector, said extension means remain fixed to and located over only a portion of and near the periphery of said connector.

2. The connection assembly claimed in claim 1 wherein said extension means cover said insulative jacket over a length from 10 mm to 20 mm.

3. The connection assembly claimed in claim 1 wherein said extension means have rounded free ends.

4. A connection between two medium-voltage electrical power cables each including at least one conductor as claimed in claim 1, surrounded by an insulative jacket, said connection including an insulative sheath adapted to cover intimately at least said connector.

5. The connection assembly claimed in claim 4 wherein the space between said connector and said insulative jacket of the corresponding cable is filled with a layer of insulative mastic.

6. The connection assembly claimed in claim 5 wherein the space between said layer of insulative mastic and each screw is filled with conductive mastic.

7. The connection assembly claimed in claim 5 wherein the space between said layer of insulative mastic and each screw is filled by a semiconductor material cap.

8. A connection assembly for connecting two medium-voltage electrical power cables, each power cable including at least one conductor surrounded by an insulative jacket, said connection assembly having a connector comprising:

tubular contacts adapted to connect together stripped ends of said conductors inserted into said tubular contacts and retained in said tubular contacts by means of screws, said screws directly contacting said stripped ends of said conductors; and at one end at least, extension means are adapted to cover a portion of said insulative jacket of said cable over a length greater than 10 mm, wherein said connector has a recessed notch such that when said extension means is attached to said connector at said recessed notch, said connector and said extension means form a continuous smooth intersection with one another and that is continuous with the outer diameter of the connector.

9. The connection assembly claimed in claim 8 wherein said extension means comprise a flexible semiconductor rubber skirt fixed to the periphery of said connector.

10. The connection assembly claimed in claim 9 wherein said flexible semiconductor rubber skirt has an internal diameter less than that of said insulative jacket of said power cable being inserted into said connector.

* * * * *